US005213145A

United States Patent [19]

Huang et al.

[11] Patent Number: 5,213,145

[45] Date of Patent: May 25, 1993

[54] SEMI-AUTOMATIC T-SHIRT BAG OPENING RACK

[75] Inventors: Frank F. J. Huang; Daniel C. Huang, both of Irvine, Calif.

[73] Assignee: Durabag Company, Inc., Tustin, Calif.

[21] Appl. No.: 778,337

[22] Filed: Oct. 15, 1991

[51] Int. Cl.[5] ..... A63B 55/04; B65B 67/04

[52] U.S. Cl. ..... 141/391; 141/314; 141/390; 248/97; 248/100; 53/390

[58] Field of Search ..... 141/10, 114, 313, 314, 141/315, 316, 317, 390, 391; 53/390, 572, 368, 369, 459, 458; 248/97, 99, 100, 101, 95, 909, 914; 383/8, 9, 37; 206/554, 466, 468, 471, 494

[56] References Cited

U.S. PATENT DOCUMENTS

| | | | |
|---|---|---|---|
| 4,480,750 | 11/1984 | Dancy | 383/8 |
| 4,830,317 | 5/1989 | Kober et al. | 248/97 |
| 4,840,336 | 6/1989 | Stroh et al. | 248/97 |
| 4,981,216 | 1/1991 | Wilfong, Jr. | 248/100 |
| 4,989,732 | 2/1991 | Smith | 206/554 |
| 5,020,750 | 6/1991 | Vrooman et al. | 53/390 |

*Primary Examiner*—Henry J. Recla
*Assistant Examiner*—Steven O. Douglas

[57] ABSTRACT

A semi-automatic T-shirt bag bagging rack and bags for use therewith. The bagging rack has a stationary rear wall with two spaced apart hooks and a tab receiving member. A support base is attached to the stationary rear wall. A movable front frame member moves between a first position distant from the stationary wall and a second position adjacent thereto. The movable front frame member has an upper planar member which is substantially parallel to the stationary rear wall and has a tacky rubber sheet member affixed thereto facing the stationary rear wall. A stack of T-shirt bags having a central tab with a central tab slit and a tab tearing slit cut therethrough and "C"-shaped cuts located near the inside edges of the handles are first loaded on the bagging rack by slipping the central tab slit of the stack of bags over the tab engaging member and by looping the "C"-shaped cuts on the handles onto the hooks on the rear wall. The movable front frame member is moved forward to bring the tacky rubber sheet member into contact with and to adhere to an upper portion of the top layer of plastic of the top bag. Thereafter, the movable wall is moved backwards. This tears the handles free from the hooks in the vicinity of the "C"-shaped cuts and tears the top layer of plastic as the tab tearing slits, thereby opening the bag.

15 Claims, 5 Drawing Sheets

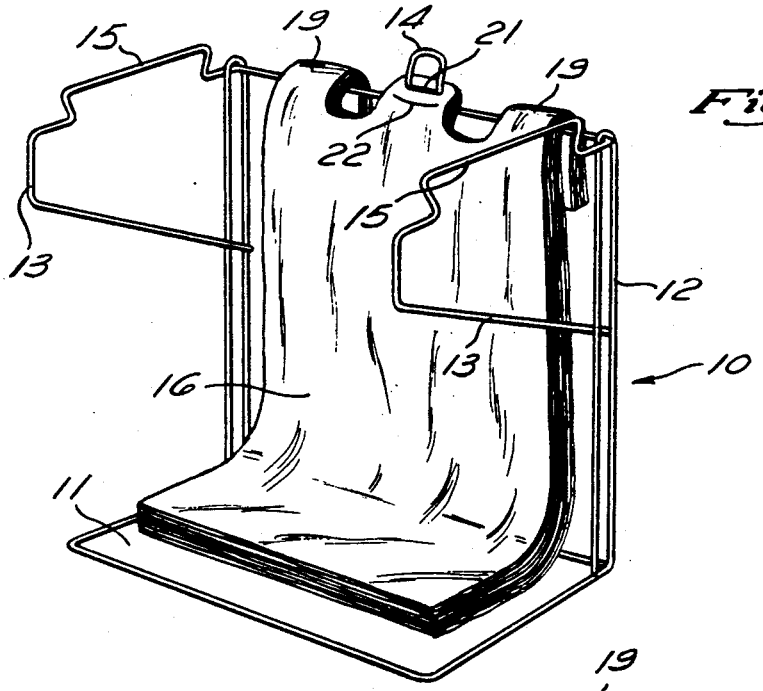
Fig. 1
(PRIOR ART)
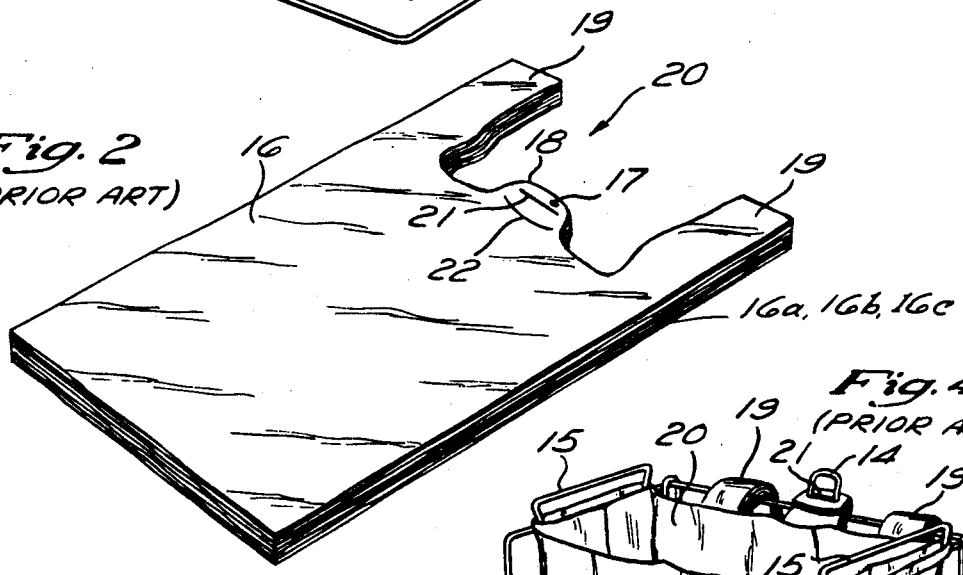
Fig. 2
(PRIOR ART)
Fig. 3
(PRIOR ART)
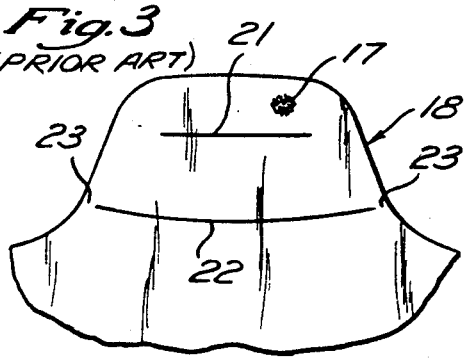
Fig. 4
(PRIOR ART)
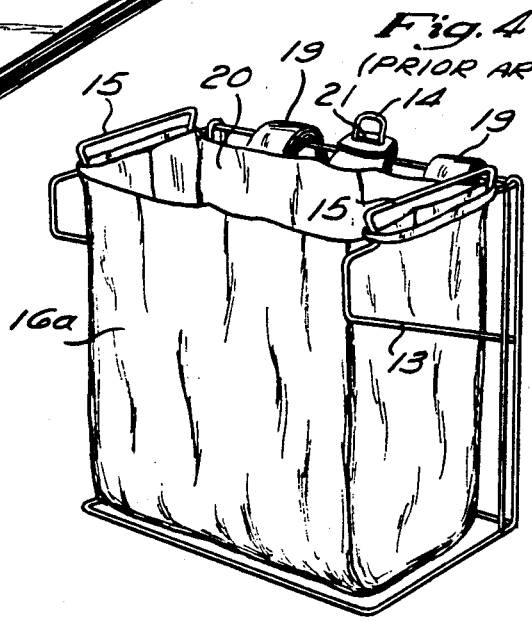

Fig. 10
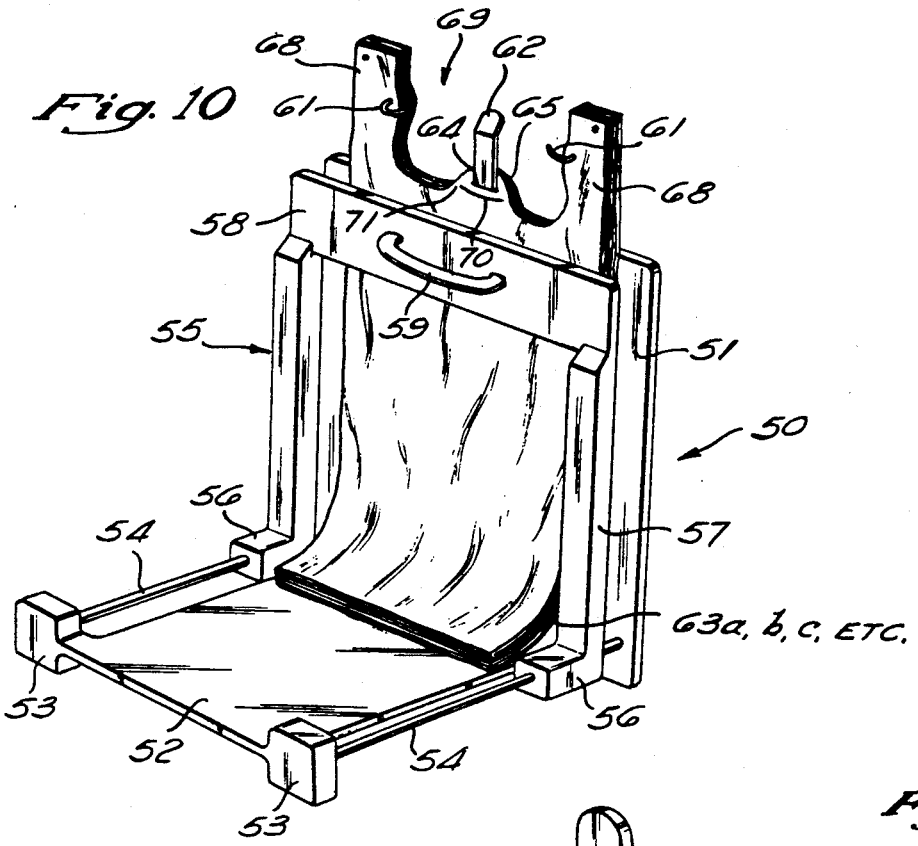
Fig. 12
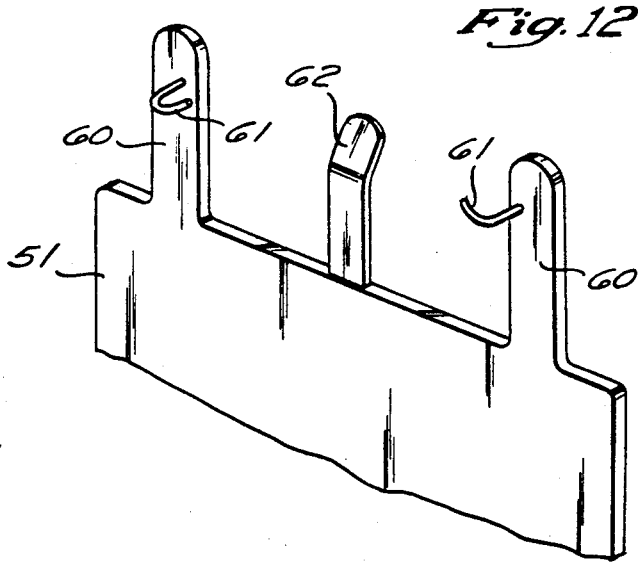
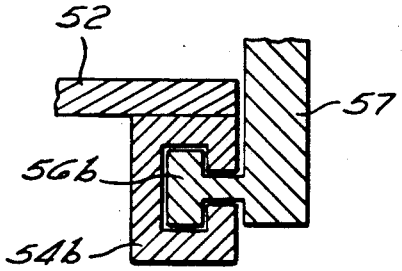
Fig. 11

Fig. 15
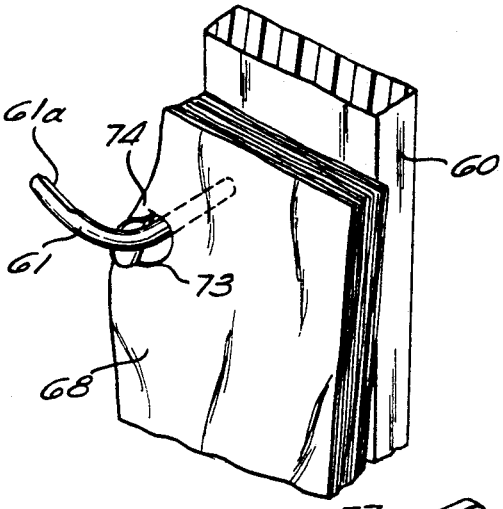
Fig 16
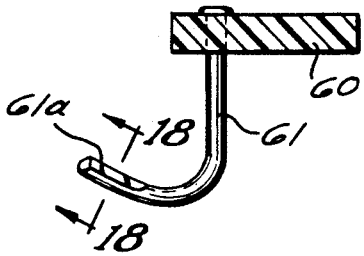
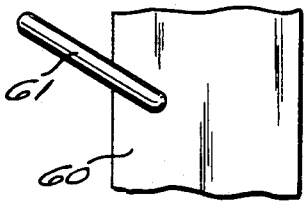
Fig. 17
Fig. 18
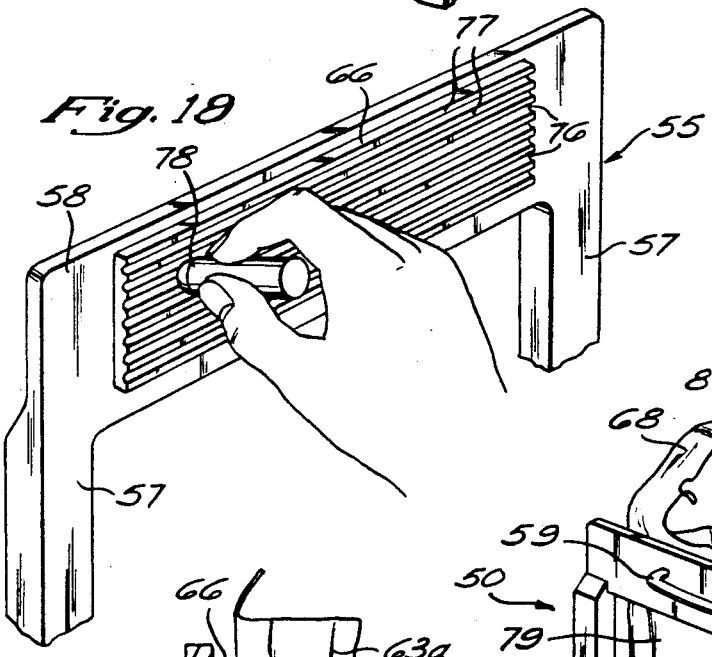
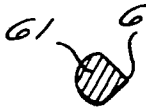
Fig. 18
Fig. 20
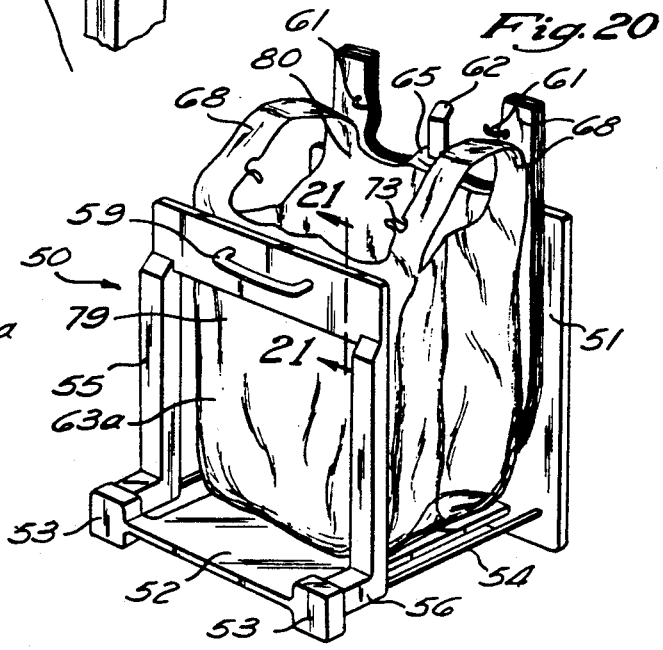
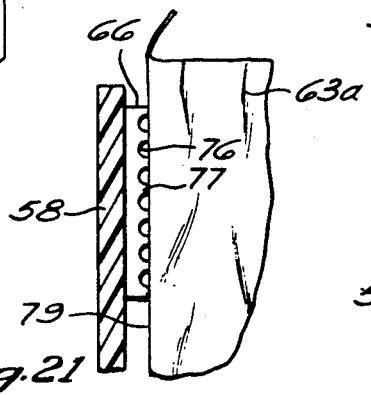
Fig. 21

SEMI-AUTOMATIC T-SHIRT BAG OPENING RACK

BACKGROUND OF THE INVENTION

1. Field of the Invention

This invention relates to racks for plastic T-shirt bags and more particularly to an automatic bagging system using a semi-automatic bag opening rack and bags for use therewith.

2. Description of the Prior Art

Since the mid-1980's, the use of all types of plastic shopping bags has grown explosively due to the great advantage plastic bags have over competing paper bags. Plastic bags are typically made of low or high density polyethylene. Because of high density polyethylene plastic's (HDPE's) greater resistance to stretching and deformation, HDPE plastic is generally used for making T-shirt bags. T-shirt bags have a pair of integral handles which make them easy to carry. HDPE bags are very strong and light and are much more compact than paper bags when delivered and stored. Furthermore, T-shirt bags are readily recyclable, and when not recycled, are non-toxic when incinerated and non-toxic in landfills. Most importantly, HDPE T-shirt bags are far less expensive than competing paper bags, making them the bag of choice for merchants.

Despite the many advantages HDPE T-shirt bags have over paper bags, due to their relatively thin material, unlike paper bags, they are not self-standing. In grocery stores, where quick loading of T-shirt bags is a necessary feature, it is thus desireable to support the bags, at least initially when merchandise is first begun to be loaded into the bags.

Two types of bagging racks for T-shirt bags are now widely in use. The first type has a support base, a wire rear wall, and two wire arms extending over the base. In the center top portion of the arms the wire is formed to have a section which will spread and hold the handles apart to open up the T-shirt bag. This type of bagging rack is depicted in FIGS. 1 to 4 and is further described below.

A second type of T-shirt bag bagging rack is shown in FIGS. 5 to 9. This types of rack is taught in U.S. Pat. Nos. 4,840,336 to Stroh, et al. and RE 33,264 to Baxley, et al. Both have a bottom support base and a wire rear wall. However, instead of looping the handles of the bags over the top of the support arm one at a time, these racks have sturdy wire arms extending forwardly from the back of the rack. Stacks of the T-shirt bags are loaded on the rack by passing the wire arms through relatively large apertures in the handle of the stack of bags. Although the Stroh, et al. and Baxley, et al. racks allow T-shirt bags to be somewhat more quickly readied for loading than the first type of rack, they suffer from two drawbacks. First, since these racks require relatively large apertures in the handles of the bags, the bags are weakened at their handles. Second, the checker or box boy still must grasp only the top layer of plastic of only the top bag in order to pull the top layer of plastic forward to thereby open the bag. Since T-shirt bags are made of very thin plastic, typically less than 1 mil. thick, it is sometimes difficult to grasp just the top layer of plastic and open the T-shirt bags.

A third type of bagging rack is taught in U.S. Pat. No. 4,830,317 to Kober, et al. In the Kober, et al. bagging rack, a stack of bags are hung on a stationary rear wall of the rack with their handles bent over the back of the stationary rear wall and retained by a friction bar. An L-shaped wall is hingedly mounted to a support base affixed to the stationary back wall and has a pair of adhesive rollers at the upper ends thereof; the rollers may be rotatably moved upwardly about the axis of the hinge to make contact with a small portion of the top layer of plastic of the top bag. The Kober, et al. device, however, is preferably used with bags in which the exposed side of the bags on the stack of bags is not affixed to a central tab. If attached-side bags are used, the adhesive must be quite strong in order to pull the bag open since the point of contact of the bag with the adhesive rollers is a relatively small area on the two cylindrical rollers. This presents a problem in removing bags loaded with merchandise since there is a tendency for the hinged wall to flip upwardly, thereby hindering the removal of the loaded bags. This tendency of the hinged wall to flip upwardly is particularly problematic when large items are loaded into the bags. A further complication with the Kober, et al. device is that due to the problem in achieving the precise retaining pressure needed on the handles of the stack of bags held on the backside of the stationary wall by the friction bar, it is difficult to ensure that only the handles of the top-most bag, being prepared for loading, and no other handles, are freed from the rear stationary wall. Lastly, in the Kober, et al. device even when the bag is fully loaded with merchandise, the handles of that bag are not accessible for immediate grasping by the checker or box boy. These problems with the Kober, et al. device prevent its smooth and complication-free operation. To the best of our knowledge, the Kober, et al. device has achieved no commercial success. There is thus a need for a true semi-automatic bag opening rack.

SUMMARY OF THE INVENTION

The present invention overcomes the above noted deficiencies of the prior art bagging racks by providing a new type of bagging rack and T-shirt bag for use therewith.

The present bagging rack has a stationary rear wall firmly connected to a bottom support base. The rack has a movable front wall which moves relative to the support base and the stationary rear wall. The movable wall has a top rail with sticky or tacky rubber material attached to its side facing the stationary rear wall. On the rear wall are two raised arms with one hook each on which a stack of T-shirt bags are hooked through two small "C"-shaped cuts near the inside edges of the handles. Also located on the rear wall is a tab receiving hook through which a slit in the central tab in the stack of bags slides to retain the stack of bags.

In the use of the rack, a stack or stacks of T-shirt bags are loaded onto the rear wall of the rack by hanging the stack of bags by its "C"-shaped cuts in the handles onto the two hooks located on the stationary rear wall. In addition, the slit in the central tab of the stack of bags is slipped over the tab receiving hook and is held in that position. Once the stacks of T-shirt bags are loaded onto the rack, the rack is ready for semi-automatic opening. When the movable wall is moved into contact with the topmost bag on the stack of loaded bags, a sticky or tacky rubber mat on the face of the top rail makes contact with the outwardly facing layer of plastic of the top bag on the stack of bags and adheres thereto. As the movable wall is then pulled back, the two handles of the top bag tear free along the "C"-shaped cuts from the hooks on the rear wall and the top layer of the central tab tears free from the central hook member along a tearing line, and the front of the bag opens up while the rear of the back stays hooked, through its central tab, to the central tab holder on the rear wall. Thus, the bag is in ready position to be easily loaded.

BRIEF DESCRIPTION OF THE DRAWINGS

FIG. 1 is a perspective view of a first type of a prior art bagging rack shown loaded with a stack of bags;

FIG. 2 is a perspective view of a stack of T-shirt bags for use with the rack of FIG. 1;

FIG. 3 is a fragmentary view of the central tab area of the stack of bags of FIG. 2;

FIG. 4 is a perspective view showing the bagging rack of FIG. 1 with a bag ready to load with merchandise;

FIG. 10 is a perspective view of the semi-automatic bagging rack of the instant invention loaded with a stack of bags;

FIG. 11 is a cross-sectional view of an alternate rail means from that shown in FIG. 10;

FIG. 12 is a fragmentary view of the rack of FIG. 10 showing the top portion of the stationary rear wall with bags loaded thereon;

FIG. 15 is a fragmentary view of one of the hooks on the rear wall loaded with handles of the stack of bags;

FIG. 16 is a fragmentary top plan view of the stationary rear wall of the rack showing on hook;

FIG. 17 is a fragmentary front view of the hook on the stationary rear wall;

FIG. 18 is a cross-sectional view of the hook through view lines 18—18 of FIG. 16;

FIG. 19 is a rear view of the movable wall showing adhesive being applied to the rubber pad;

FIG. 20 is a perspective view showing the operation of the bag rack of FIG. 10 with the top bag being opened by the rack;

FIG. 21 is a fragmentary view of the rubber pad on the movable wall sticking to the plastic bag taken through lines 21—21 of FIG. 20.

Figure 5:
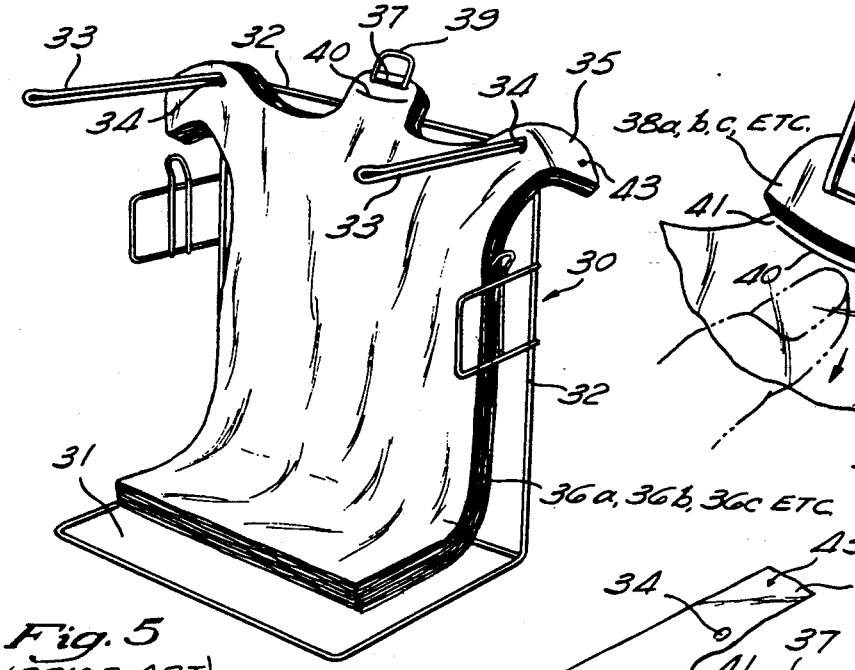
Fig. 5 (PRIOR ART)
FIG. 5 is a perspective view of a second type of a prior art bagging rack shown loaded with a stack of bags.

DESCRIPTION OF THE PREFERRED EMBODIMENTS a) Description of Prior Art Bagging Racks

Referring now to the drawings, there is illustrated in FIGS. 1-9 the first two types of the prior art bagging racks now widely in use. In the prior art rack illustrated in FIGS. 1 to 4, the rack 10 has a base plate 11, a rear wire wall 12, and two hanger arms 13 extending from the rear wire base 12 to over the plane of the base plate 11. A tab receiving hook element 14 is centered on the top of the rear wire wall 12. The two hanger arms 13 have raised bag handles engaging and separating portions 15. The stack of plastic T-shirt bags 16 consists of a stack of overlapped bags 16*a, b, c,* etc. heat sealed together at a point or points 17 on the central tab portion 18 which lies between the handles 19 on opposite sides of mouth 20 of the plastic bags. The heat sealed central tabs 18 thus form a stack or book of central tabs which stay engaged with the tab receiving hook element 14 even after individual bags are removed. The central portion tab 18 has a central tab slit 21 which is sufficiently wide to barely slide over the tab receiving hook 14 of the rack 10. Below the central tab aperture 21 is a tearing slit 22 which transverse almost the entire distance of the central tab 18 except for a small distance 23 at both sides of the central tab 18.

The stack of plastic bags 116 is loaded onto the rack 10 by sliding the central tab slit 21 over the tab receiving hook element 14 and flopping the arm of the bags 19 over the back of the rear wire wall 12.

In preparing a single bag 16*a* for loading with merchandise, the cashier or box boy grabs the top bag and tears it free from the central tab along the tearing slit 22. The box boy then manually loops the handles 19 of the single bag 16*a* over the handle engaging portions 15 of the rack 10 and spreads the mouth 20 of the bag 16*a* open. This is a time consuming process.

The second general type of prior art bagging rack is shown in FIGS. 5 to 9. Like the first described prior art bagging rack, the second type of rack 30 has a base support plate 31 and a rear wire wall 32. However, instead of relying on bag handle separating portions on the two hanger arms to open and hang the bags, it uses two elongate support arms 33 which are slipped through apertures 34 in the handles 35 of the stack of bags 36*a, b, c,* etc. Likewise, the stack of bags 36*a, b, c,* etc. is retained on the back wire wall 32 by sliding the central tab slit 37 in the central tab 38 of the bags over the central tab retaining member 39 on the rear wire wall 32. Like the first embodiment, the stack of bags 36*a, b, c,* etc., has a tearing slit 40 which extends almost all the way across the central tab 38, except for a small portion 41. The bags 36*a, b, c,* etc., are heat welded together at point or points 42 on the central tabs to form a book of central tabs 38*a, b, c,* etc. which stays hooked on the central tab retaining member 39. Additionally, heat welds 43 fuse the handles together.

Figure 8:
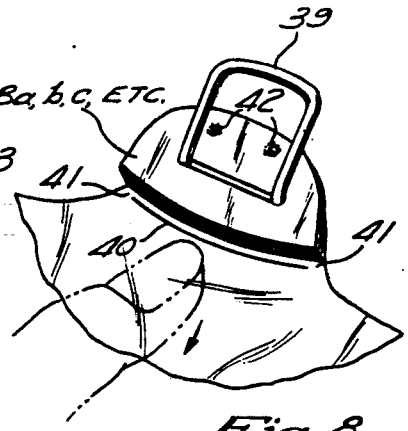
Fig. 8 (PRIOR ART)
FIG. 8 is a fragmentary view of the central tab portion of the bags of FIG. 5 showing the book of central tabs and how the bag is opened.
Figure 6:
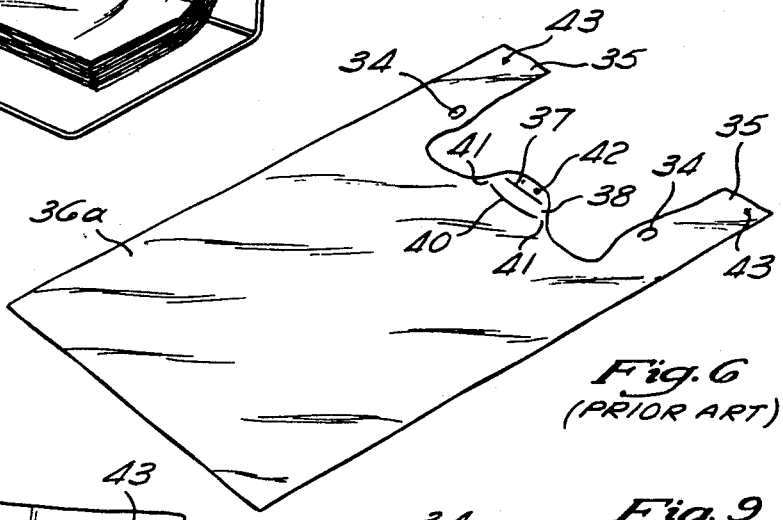
Fig. 6 (PRIOR ART)
FIG. 6 is a perspective view of a bag for use with the rack of FIG. 5
Figure 7:
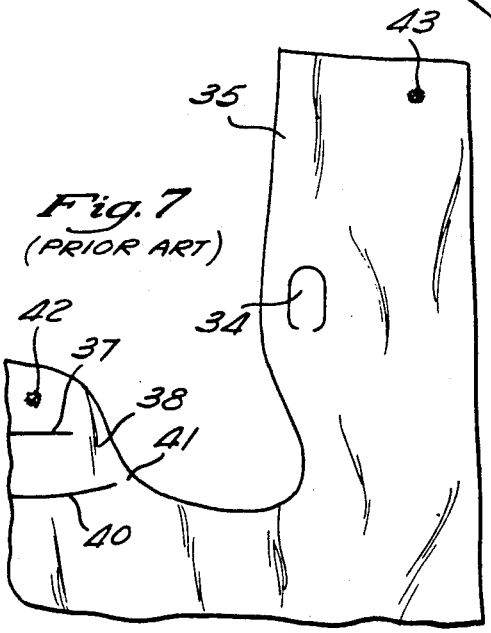
Fig. 7 (PRIOR ART)
FIG. 7 is a fragmentary view of the handle and a portion of the central tab of the bag of FIG. 6 showing the hanging aperture on the handle.
Figure 9:
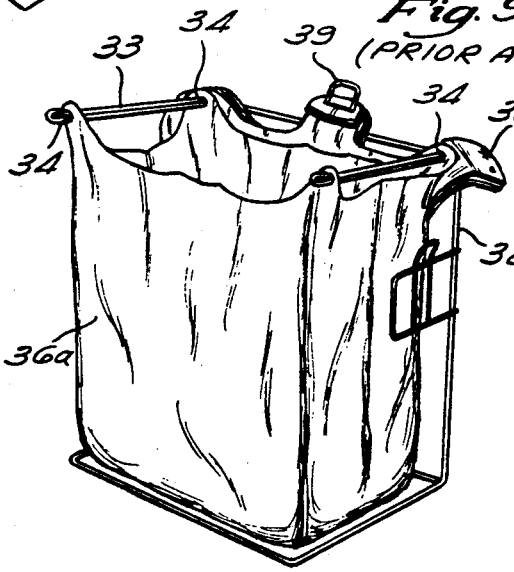
Fig. 9 (PRIOR ART)
FIG. 9 is a perspective view showing the bagging rack of FIG. 5 with a bag ready to load with merchandise.

When the cashier or box boy wishes to ready a single bag for loading, he or she will grasp the top layer of the top bag 36*a* with his/her fingers near the tearing slit 40 and pull the top layer forward, as shown in FIG. 8. Due to the tension exerted on the bags between the aperture 34 in the handles, when the top layer of the top bag 36*a* is pulled forward, the top bag 36*a* will thus be opened up.

Having described the structure and function of two of well-known prior art bagging racks and the bags for use therewith, the inventor now describes the instant bagging rack and bags for use therewith.

b) Preferred Embodiment of the Invention

FIG. 10 is a perspective view of the automatic bagging rack 50 of the invention. The automatic bagging rack 50 has a stationary rear wall 51 which is fixably mounted at its bottom portion to a support base 52. The support base 52 is raised off the ground by leg members 53, which also act as movable frame member stops, located at the front of the support base 52 and at its rear by the stationary rear wall 51. Rail means 54 span the distance between the leg members 53 and the stationary rear wall 51. A movable front frame member has rail engaging means 56 located at the bottom of its risers 57 to allow the movable front frame member to slide on the rail means 54.

To allow low friction sliding of the movable front rack 55 on the rail means 54, linear bearing (not shown) can be installed in the rail engaging means 56. As an alternative to the arrangement above described, FIG. 11 shows a "C"-shaped track member **54*b* can be mounted near the support base 52 and instead of the block type rail engaging member 56, a roller or slides 56*b*, be utilized to slide within the "C"-shaped track 54*b* positioned at the bottom of the risers 57**.

Located beneath the support base 52, the rail engaging means 56 are preferably joined together with a bottom rail which passes under the support base 52 (not shown) to help rigidify the movable frame member 55.

A top planar member 88 spans the two risers 57. A handle 59 is mounted to the front face of the top planar member 58 to aid in moving the movable front frame member 55 on the rail means 54 relative to the stationary back wall 51 and the support base 52. The rear stationary wall 51 and support base 52 are preferably made from a single piece of sheet aluminum, steel, plastic, or other rigid material. The movable front frame member 55 is also constructed of a rigid material. Located near the top of two upwardly extending arms 60 of the rear wall 51 are one hook 61 each. The hooks 61 extend forwardly of the rear wall 51 and extend generally inwardly. A tab engaging member 62 is located at the top of the rear wall 51 approximately midway between the two upwardly extending arms 60. These features are best shown in FIG. 12. The tab engaging member 62 is preferably over two inches long and is bent slightly backwards at its top in order to allow several of the stacks of bags **63*a, b, c,* etc., best shown in FIG. 13, to be loaded thereon. The tab engaging member 62 is sized to tightly slip through a central tab slit 64 in the central tab 65 of the stacks of bags 63*a, b, c,* etc. The top planar member 58 of the movable wall 55 has a rubber sheet member 66 affixed to its side facing the stationary rear wall 51, as shown in FIGS. 19 and 21**.

Figure 13:
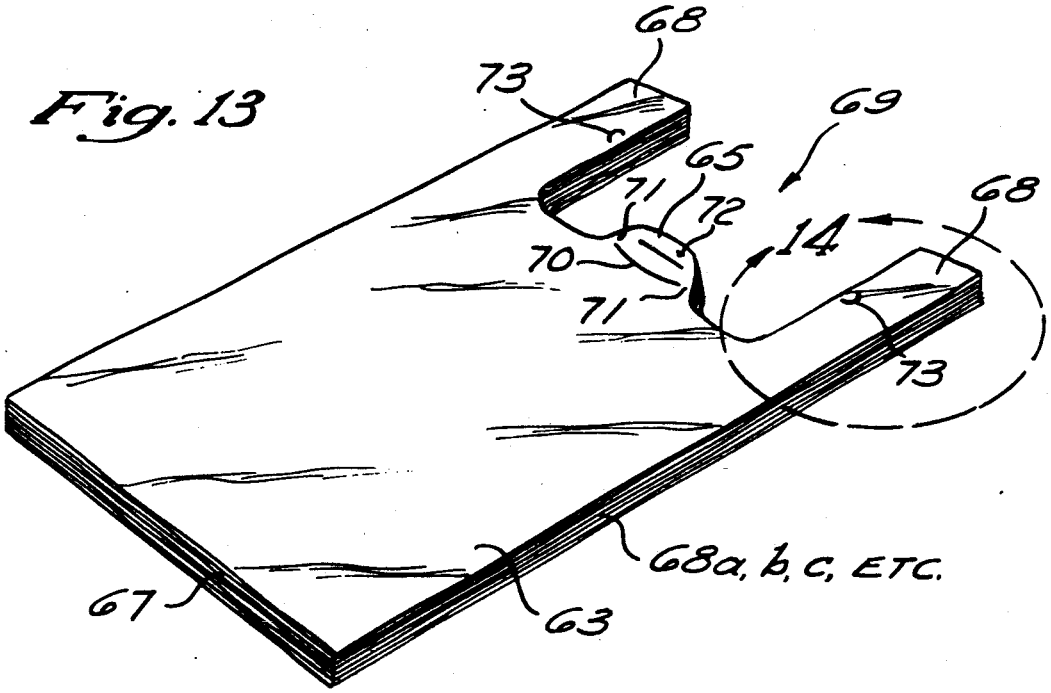
FIG. 13 is a perspective view of a stack of bags of the invention.
Figure 14:
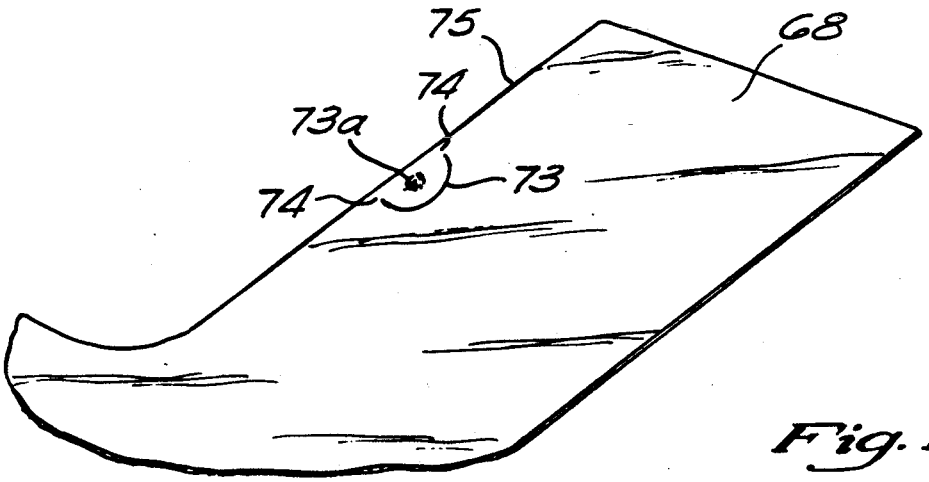
FIG. 14 is a fragmentary view of FIG. 13 showing the "C"-shaped cuts in the handles of the bags.

FIG. 13 is a top plan view of a stack of plastic T-shirt bag **63*a, b, c,* etc., of the invention. The plastic T-shirt bags are pleated bags which are each individually heat sealed closed at a bottom edge 67. The central tab 65 is located between the handles 68 on both sides of the mouth 69 of the bags 63*a, b, c,* etc. As with the prior art bags, a tearing slit 70 extends almost all the way across the tab 65, except for a small portion 71, which is preferable approximately ⅜ inches away from the outer edge of the central tab 65. The central tabs 65 of the stack of bags 63*a, b, c,* etc., are heat welded together at a point or points 72**.

A "C"-shaped cut 73 is made near the top portion of each handle 68. The "C"-shaped cut 73 is spaced approximately 1/32 inches away from the inside-most edges 75 of the handles 68 by material 74. This small amount of material 74 tears easily when the top bag **63*a* is opened, as will be more fully discussed below. Preferably, these "C"-shaped sections can be held together by a pin hole heat seal 73*a* to allow easier loading of the handles 68 on the hooks 61**.

The stack of plastic bags **63*a, b, c,* etc. is loaded on the rack 50 with the hooks 61 on the extending arms 60 of the rear wall 51 made to pass through "C"-shaped cuts 73 and with the central tab engaging member 62 passing through the central tab slit 64. Thus loaded, the stack of bags 63*a, b, c,* etc., lies substantially flatly, at least at its top portions against the rear stationary wall 51, as clearly shown in FIG. 10**.

As shown in FIGS. 15 to 18, the two hooks 61 are curved inwardly and upwardly and preferably have a sharp edge **61*a* to aid in freeing the top bag 63*a* at the "C"-shaped cut 73 by tearing near the material 74 of the handles 68**.

As shown in FIGS. 19 and 21, the frontwardly facing surface of the top planar member 58 has a rubber sheet member 66 permanently affixed thereto. The rubber sheet member 66 can either have a flat and smooth surface or, more preferably, can have a patterned surface with repeating grooves 76 and ridges 77. In order to provide the necessary stickiness and adhesive quality needed to stick the rubber sheet member 66 to the top layer of plastic 79 of the top bag **63*a* of the stack of loaded plastic bags 63*a, b, c,* etc., paste type adhesives, such as that found in glue sticks 78 can be wiped onto the rubber sheet member 66. The rubber sheet member 66 is approximately as long as the front of the plastic bags 63*a, b, c,* etc. and is relatively wide to provide a large area of contact. The exposed grooves 76 and ridges 77 will help to capture a sufficient amount of the adhesive 78 thus applied to allow one glue application to be sufficient to open 50 or more T-shirt bags before adhesive 78 must again be applied to the rubber sheet member 66. Alternately, a permanently sticky or tacky rubber sheet or plastic material can be used in place of the rubber sheet member 66 in conjunction with glue 78 to avoid the need to repeatedly apply the glue 78**.

After glue 78 is applied to the rubber sheet member 66, the bagging rack 50 is ready for use. The checker or box boy wishing to ready a T-shirt bag **63*a* for loading with merchandise will grasp the handle 59 of the movable wall 55 and slide it from its initial position where it is near the leg member 53 (not shown), in the direction of the stationary rear wall 51 and the stack of bags 63*a, b, c,* etc., disposed thereon. When the top planar member 58 makes contact with the top layer of plastic 79 of the top plastic bag 63*a*, the tacky rubber member 66 will immediately adhere thereto. The movable wall 55 is then pulled backwards towards its initial position near the leg members 53. This action accomplishes two things. First, the top layer of plastic 79 of the top plastic bag 63*a* tears free from its central tab 65 along the tearing slit 70. As the movable wall 55 is moved further back, the two handles 66 of the top bag break free from the two hooks 61 along the "C"-shaped cuts 73 and detach. The top bag 63*a* is thus opened up, as shown in FIG. 20, with the rear layer of plastic 80 of the top bag 63*a* still being attached to the book of central tabs 65, and the front layer or plastic being adhesively attached to rubber sheet member 66 on the front movable wall 55**. All of this is accomplished without the need for individually grasping any single bag as was required by many of the prior art racks.

Once the checker or box boy completes the loading of bag **63*a*, the free handles 68 of the bag 63*a* are then grabbed and pulled, which easily detaches the top plastic layer 79 of the top bag 63*a* from the rubber sheet material 66 and tears away the rear plastic portion of the wall of the wall 63*a* along tearing slit 70. To ready the newly exposed top bag 63b for loading, the process is simply repeated, with glue 78** being applied every 50 to 100 cycles or so, or as needed.

I claim:

1. An semi-automatic bag opening rack for use with plastic bags comprising:

a stationary rear wall, said rear wall having a plurality of spaced apart hook member attached at a top portion of said rear wall and having a generally upwardly projecting tab receiving member located thereon;

a planar support base perpendicular to and fixably attached to said stationary rear wall and extending in a forward direction therefrom; and a movable frame member movable along a straight line between a first position distant from said stationary rear wall and a second position adjacent to said stationary rear wall, said movable frame member having an upper planar member which is substantially parallel to said stationary rear wall at all times and which has a tacky rubber sheet member fixed to a surface of said upper planar member which faces said fixed rear wall, wherein in use of said bagging rack, a stack of bags having a central tab with a central tab slit and a tab tearing slit and cuts located near inside edges of handles of said bags are first loaded onto said bagging rack by slipping said central tab slit of said stack of bags over said tab receiving member and by looping said cuts of said handles onto said hooks and after said stack of bags is loaded, moving said movable frame member from said first position to said second position, thereby bringing said tacky rubber sheet member on said upper planar member into contact with and adhering to a portion of a top layer of plastic of a top bag of said stack of bags, and thereafter moving said movable frame member from said second position back to said first position, thereby tearing said handles free from said hooks in the vicinity of said cuts and tearing the top layer of plastic of said top bag at said tab tearing slit, and hereby opening said top bag.

2. The semi-automatic bag opening rack of claim 1, wherein when said movable frame member wall is moved from said second position to said first position, the top layer of plastic of said bag in the vicinity of said tab separation slit is torn free and said handles are torn free from said hooks in the vicinity of said cuts on said handles.

3. The semi-automatic bag opening rack of claim 1 wherein said cuts on said handles are "C"-shaped cuts made approximately 1/32 inches away from an inner edge of each handle such that said handles of said top bag on said stack of bags are torn free from said hook members when said bag is opened.

4. The semi-automatic bag opening rack of claim 3, wherein the material of said bags in the vicinity of said "C"-shaped cuts is held together by a heat-sealed pin hole.

5. The semi-automatic bag opening rack of claim 1, wherein said hook members project forwardly and upwardly from said rear stationary wall and have a cutting edge located at least partially along an inside edge of curvature of said hooks.

6. The semi-automatic bag opening rack of claim 1, wherein said tab receiving member is at least two inches long and is curved backwardly at its top end to allow at least one stack of bags to be retained thereon.

7. The semi-automatic bag opening rack of claim 1, wherein said tacky rubber planar member on said upper planar member is made tacky by applying an adhesive thereto.

8. The semi-automatic bag opening rack of claim 1, wherein said tacky rubber planar member is permanently tacky.

9. The semi-automatic bag opening rack of claim 1, wherein said movable frame member moves on rail means located in the vicinity of said planar support plate.

10. The semi-automatic bag opening rack of claim 9, wherein said rail means comprises:

a pair of rails perpendicular to and extending between a bottom portion of said rear stationary wall and a movable frame member stop means located at a front portion of said planar support base distant from said stationary wall; and pair of rail engagement means, each one located at a bottom portion of two legs of said movable frame member which extend downwardly from said upper planar member.

11. The semi-automatic bag opening rack of claim 10, wherein each of said pairs of rails are tubular rails and said rail engaging means comprise a block with ball bearings which glide on said tubular rails.

12. The semi-automatic bag opening rack of claim 10, wherein each of said pairs of rails are "C"-shaped and said rail engaging means comprise a portion which slides within said "C"-shaped rails.

13. The semi-automatic bag opening rack of claim 1 wherein said upper planar member has a grasping member located on its side facing away from said stationary rear wall.

14. The semi-automatic bag opening rack of claim 1, wherein said movable frame member is slidably movable along a straight line.

15. A semi-automatic bag dispensing system comprising:

a stack of bags comprising a plurality of bags stacked in alignment, each bag of said stacked bags having front and rear walls joined by side walls, said bags having an open top and a pair of laterally spaced apart upwardly projecting handles, each handle having aligned slits defined therethrough near a side edge of said handles near a top portion of said handles, each bag having detachable tab means projecting upwardly from said open top of each bag between the laterally spaced apart handles, said tab means including a central tab slit defined therethrough and a tab tearing slit formed below said central tab slit, said tab tearing slit traversing substantially the entire width of said central tab means;

a bagging rack for mounting said stack of bags and readying for loading individual bags from said stacks of bags, said bagging rack comprising:

a stationary rear wall, said rear wall having two spaced apart hook member attached at a top portion of said rear wall and having a generally upwardly projecting tab receiving member located thereon;

a planar support base perpendicular to and fixably attached to said stationary rear wall and extending in a forward direction therefrom; and a movable frame member movable along a straight line between a first position distant from said stationary rear wall and a second position adjacent to said stationary rear wall, said movable frame member having an upper planar member which is substantially parallel to said stationary rear wall and which has a tacky rubber sheet member fixed to a surface of said upper planar member which faces said fixed rear wall, wherein in use of said bag dispensing system, a stack of said bags is first loaded onto said bagging rack by slipping said central tab slit of said stack of bags over said tab receiving member and by looping said aligned slits in said handles onto said hook members, and after said stack of bags is loaded, moving said movable frame member from said first position to said second position, thereby bringing said tacky rubber sheet member on said upper planar member into contact with and adhering to a portion of a front wall of plastic of a top bag of said stack of bags, and thereafter moving said movable frame member from said second position back to said first position, thereby tearing said handles free from said hook members in the vicinity of said slits in the handles and tearing the top layer of plastic of said top bag at said tab tearing slit, and thereby opening said top bag.

* * * * *